US009663992B2

(12) United States Patent
Lehr

(10) Patent No.: US 9,663,992 B2
(45) Date of Patent: May 30, 2017

(54) DOWNHOLE MOTOR FOR EXTENDED REACH APPLICATIONS

(71) Applicant: BAKER HUGHES INCORPORATED, Houston, TX (US)

(72) Inventor: Joerg Lehr, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 130 days.

(21) Appl. No.: 14/469,240

(22) Filed: Aug. 26, 2014

(65) Prior Publication Data

US 2016/0060958 A1 Mar. 3, 2016

(51) Int. Cl.

| | |
|---|---|
| ***E21B 4/18*** | (2006.01) |
| ***E21B 44/04*** | (2006.01) |
| ***E21B 4/02*** | (2006.01) |

(52) U.S. Cl.

CPC ..... *E21B 4/18* (2013.01); *E21B 4/02* (2013.01); *E21B 44/04* (2013.01)

(58) Field of Classification Search

USPC ..... 175/57, 26, 27, 94

See application file for complete search history.

(56) References Cited

U.S. PATENT DOCUMENTS

| | | | |
|---|---|---|---|
| 4,844,180 A | 7/1989 | Zijsling | |
| 5,960,895 A | 10/1999 | Chevallier et al. | |
| 2001/0045300 A1 | 11/2001 | Fincher et al. | |
| 2005/0211471 A1 | 9/2005 | Zupanick | |
| 2008/0277166 A1 | 11/2008 | Orban et al. | |
| 2011/0174541 A1* | 7/2011 | Strachan | E21B 44/00 175/27 |
| 2012/0024539 A1 | 2/2012 | Lehr | |

FOREIGN PATENT DOCUMENTS

| | | |
|---|---|---|
| GB | 2335450 A | 9/1999 |
| WO | 2012012632 A1 | 1/2012 |

OTHER PUBLICATIONS

PCT/US2015/046532—International Search Report dated Oct. 26, 2015.

* cited by examiner

*Primary Examiner* — Taras P Bemko

(74) *Attorney, Agent, or Firm* — Mossman, Kumar & Tyler, PC

(57) ABSTRACT

An apparatus for forming a wellbore in a subterranean formation includes a drill bit, a connector connected to the drill bit and configured to transmit torque and thrust to the drill bit, and a drilling motor energized by a pressurized fluid. The drilling motor may include a stator and a rotor disposed in the stator and having a torque transmitting connection to the connector. The apparatus may also include a thrust generator associated with the rotor and having a pressure face in pressure communication with a fluid flowing through the drilling motor and a force application assembly selectively anchoring the stator to a wellbore wall. A related method uses the apparatus to drill a wellbore.

16 Claims, 3 Drawing Sheets

DOWNHOLE MOTOR FOR EXTENDED REACH APPLICATIONS

CROSS-REFERENCE TO RELATED APPLICATIONS

None.

BACKGROUND OF THE DISCLOSURE

1. Field of the Disclosure

This disclosure relates generally to oilfield downhole tools and more particularly to drilling assemblies utilized for extended reach drilling operations.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of current drilling activity involves drilling deviated wellbores to more fully exploit hydrocarbon reservoirs. A deviated wellbore is a wellbore that is not vertical (e.g., a horizontal). The deviated section of such a borehole can extend thousands of feet from a vertical section of that wellbore. Conventionally, the weight of the drill string in the vertical section provides the weight on bit (WOB) needed to press the drill bit against the formation during drilling. As the length of the deviated sections increase, the available WOB diminishes due to drag forces and other environmental factors. The present disclosure addresses the need to provide WOB in instances where the weight of the drill string is insufficient to maintain the WOB needed for efficient cutting of the formation, as well as other needs of the prior art.

SUMMARY OF THE DISCLOSURE

In aspects, the present disclosure provides an apparatus for forming a wellbore in a subterranean formation. The apparatus may include a drill bit, a connector connected to the drill bit and configured to transmit torque and thrust to the drill bit, and a drilling motor energized by a pressurized fluid. The drilling motor may include a stator and a rotor disposed in the stator and having a torque transmitting connection to the connector. The apparatus may also include a thrust generator associated with the rotor and having a pressure face in pressure communication with a fluid flowing through the drilling motor and a force application assembly selectively anchoring the stator to a wellbore wall.

In aspects, the present disclosure provides a method for forming a wellbore in a subterranean formation. The method may include forming a drilling assembly having: a drill bit, a connector connected to the drill bit, the connector being configured to transmit torque and thrust to the drill bit, a drilling motor energized by a pressurized fluid and including a rotor disposed in a stator and having a torque transmitting connection to the connector, a thrust generator associated with the rotor, the thrust generator having a pressure face in pressure communication with a fluid flowing through the drilling motor, and a force application assembly selectively anchoring the stator to a wellbore wall. The method may also include conveying the drilling assembly into the wellbore and pushing the drill bit against a wellbore bottom of the wellbore using a thrust generated by the drilling motor.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide a drilling assembly that generates local weight on bit (WOB) using a drilling motor. In general, the pressure differential across the drilling motor is used to generate rotary power and axial thrust for the drill bit. In some embodiments, this differential pressure translates a rotor of the drilling motor a predetermined distance, which is the same distance the drill bit advances into the formation being drilled. A force application assembly can anchor a portion of the drilling assembly that includes the stator of the drilling motor to a wellbore wall while the rotor applies the thrust to the drill bit. Once the drill bit has travelled the predetermined distance, the force application member is deactivated to release the drilling assembly from the wellbore wall. The drilling assembly may be slid forward using drill string weight and/or some other mechanism, which resets the position of the rotor. Illustrative non-limiting embodiments are described in greater detail below.

Figure 1:
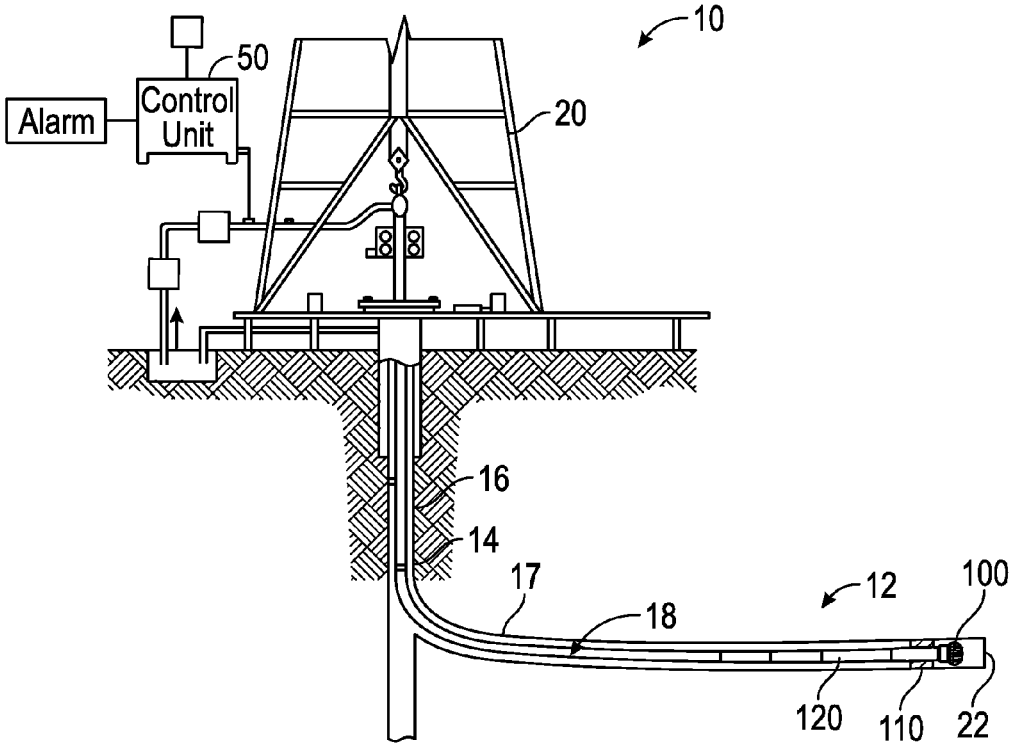
FIG. 1 illustrates a drilling system made in accordance with one embodiment of the present disclosure.

Referring now to FIG. 1, there is shown one illustrative embodiment of a drilling system 10 utilizing a steerable drilling assembly or bottomhole assembly (BHA) 12 for directionally drilling a wellbore 14. The wellbore 14 has a vertical section 16 and a deviated section 17. While shown as horizontal, the deviated section 17 may have any inclination or inclinations relative to vertical. Also, while a land-based rig is shown, these concepts and the methods are equally applicable to offshore drilling systems. The system 10 may include a drill string 18 suspended from a rig 20. The drill string 18, which may be jointed tubulars or coiled tubing, may include power and/or data conductors such as wires for providing bidirectional communication and power transmission. In one configuration, the BHA 12 includes a drill bit 100, a force applicator assembly 110 that provides an anchoring force and/or a steering force, and a drilling motor 120 for rotating and thrusting the drill bit 100.

As will discussed in greater detail below, the drilling motor 120 generates both the torque for rotating the drill bit 100 and the thrust force, or WOB, to press the drill bit 100 forward against the formation at a wellbore bottom 22. The drilling motor 120 may be any motor that is energized by pressurized fluid, such as drilling mud. One suitable mud motor is a progressive cavity positive displacement motor (or moineau motor). When a reaction force is present to resist rotation of the drilling motor rotor 122 (FIG. 2), the differential pressure across the drilling motor 120 generates torque and thrust that are applied to the drill bit 100. The applied thrust can act as the only WOB for the drill bit 100. Alternatively, the applied thrust can cooperate with another WOB generator (e.g., drill string weight) to provide a fractional amount of the needed WOB (e.g., 90%, 50%, 20%, etc.).

Figure 2:
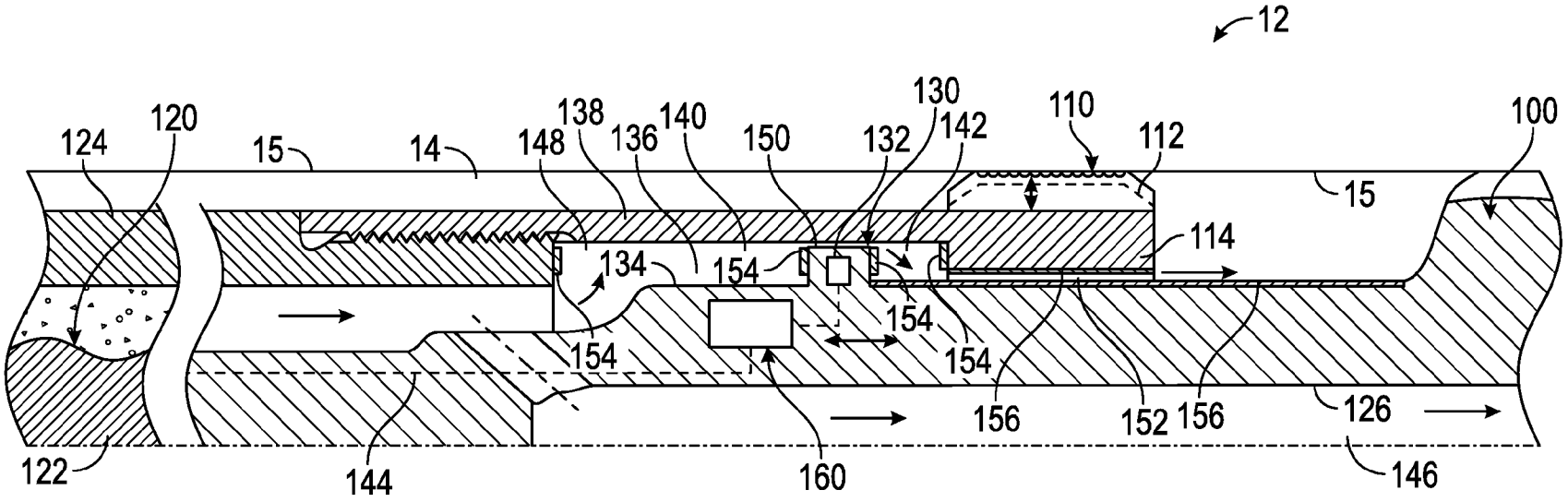
FIG. 2 schematically illustrates a thrust generating drilling motor device made in accordance with one embodiment of the present disclosure.

FIG. 2 sectionally illustrates a section of the BHA 12 that uses one non-limiting embodiment of a drilling motor 120 according to the present disclosure. The drilling motor 120 includes a rotor 122 disposed in a stator housing 124. In a conventional manner, the rotor 122 and the stator housing 124 have co-acting lobes (not shown). When pressurized fluid flows across the drilling motor 120, the lobes (not shown) create fluid chambers that rotate the rotor 122. In embodiments of the present disclosure, the pressure differential in the fluid also generates an axial force that thrusts the rotor 122 toward the drill bit 100.

In one arrangement, this axial force can be generated at a thrust generator 130 that is formed on an outer surface of a torque and thrust transmitting connector 126. The connector 126 transfers the torque and thrust generated by the rotor 122 to the drill bit 100. The connector 126 may be formed as a shaft or tube. The thrust generator 130 may be an annular rib 132 formed on an outer surface 134 of the connector 126. The rib 132 functions as a piston head that translates or strokes within an annular chamber 136 separating the connector 126 from an enclosure 138. The rib 132 also separates the annular chamber 136 into a power chamber 140 and a reset chamber 142. During operation, pressurized fluid in the power chamber 140 acts on the pressure surfaces of the rib 132 to generate the desired thrust force. It should be appreciated that the described embodiments can work as a downhole motor for an Integrated Extension System (INES). INES allows a drilling assembly to work independently from applied weight/force on top of a drilling motor.

The connector 126 may include passages and cavities to direct drilling fluid to the annular chamber 136 and also to the drill bit 100. In one arrangement, the connector 126 includes one or more passages 144 that convey some of the drilling fluid exiting the drilling motor 120 into a central bore 146 that is in fluid communication with nozzles (not shown) associated with the drill bit 100. The connector 126 also includes a passage 148 that conveys the remaining drilling fluid exiting the drilling motor 120 into the power chamber 140. The passages 144, 148 are hydraulically parallel. That is, one passage does not direct flow into the other passage.

The fluid in the power chamber 140 can enter the reset chamber 142 via a gap 150 between the enclosure 138 and the rib 132. The fluid can exit the reset chamber 142 via a gap 152 between the enclosure 138 and/or support 114. It should be noted that a continuous flow of fluid is maintained through the power chamber 150 due to the gaps 150, 152.

The force application assembly 110 selectively engages a borehole wall 15 to anchor a portion of the BHA 12 to the borehole wall 15 when the thrust force is applied to the drill bit 100. Additionally or alternatively, the force application assembly 110 can steer the drill bit 100. In one embodiment, the force application member 110 includes a plurality of extensible pads 112 that are circumferentially distributed around a support 114. Known power sources (not shown) such as hydraulic systems and electrical motors may be used to radially extend and retract the pads 112.

When two or more of the extensive pads 112 are extended and engaged with the borehole wall 15, the portions of the BHA 12 that are rigidly fixed to the support 114, such as the enclosure 138 and the stator housing 124, are kept stationary relative to the borehole wall 15. Thus, the thrust generator 130 can move axially relative to the enclosure 138 and apply a thrust force to the drill bit 100. It should be appreciated that the force application assembly 110 can steer the drill bit 100 while anchoring the BHA 12. For example, the pads 112 may be extended different radial distances to eccentrically position the support 114 relative to the wellbore 14. Thus, the drill bit 100 may be "pointed" in a direction that is not co-axial with a longitudinally axis of the wellbore 14.

Because the rib 132 is fixed to the connector 126, the rib 132 may encounter sliding contact with the enclosure 138 during rotation. To minimize wear, the ribs 132 and the enclosure may include wear inserts 154, such as diamond inserts, to accommodate this relative sliding contact. Additionally, wear inserts 156 may be used to accommodate relative rotational movement between the connector 126 and the enclosure 138 and/or support 114. Fluid flowing through the chamber 136 may be used to lubricate the contacting surfaces of the wear inserts 156. The wear inserts 154 may work as thrust bearings and may be constructed to take over an entire thrust load (WOB) from the bit 100 or the rib 132.

In some embodiments, the BHA 12 may be pre-configured such that the behavior of the BHA 12 does not adapt to changes in operating conditions. In other embodiments, a controller 160 may be used to dynamically adjust operating set points in response to one or more measured downhole parameters.

Figure 3:
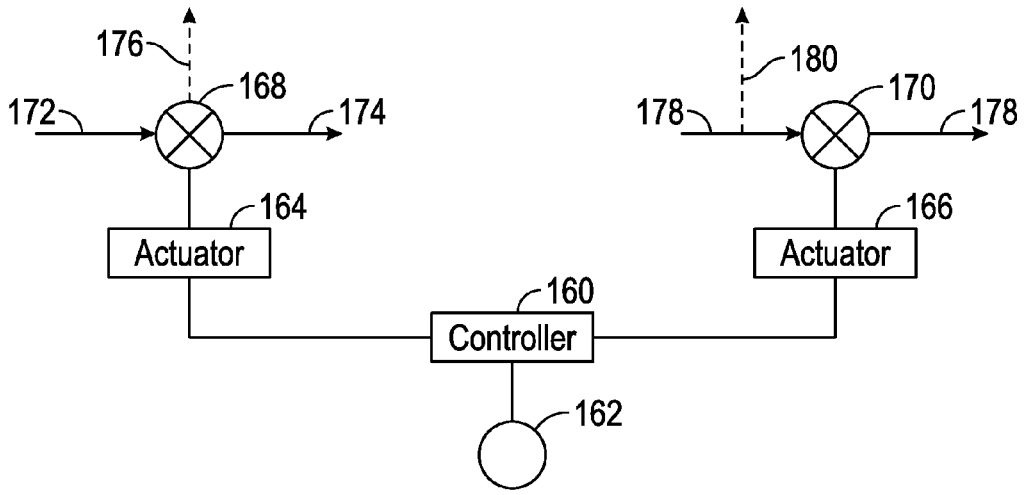
FIG. 3 schematically illustrates a control system for controlling a thrust generating drilling motor device made in accordance with one embodiment of the present disclosure.

FIG. 3 schematically illustrate an exemplary arrangement wherein the controller 160 may be in signal communication with one or more sensors 162 such as linear displacement sensors, angular displacement sensors, pressure sensors, flow rate sensors, temperature sensors, RPM sensors, torque sensors, and other position, environmental and drilling parameter sensors. The information provided by these sensors 162 may be used by an appropriately programmed microprocessor in the controller 160 to control one or more actuators 164, 166 that control flow control devices such valves 168, 170 to obtain a desired response. Exemplary responses may be a desired parameter associated with the drill bit, such as WOB or torque being within a predetermined range. Other exemplary responses may be a reduction in vibration of the BHA e.g. stick slip, lateral, whirl, bit bounce. Still another exemplary response may be a change in the depth of cut of the drill bit 100.

In some embodiments, the controller 160 may operate the actuator 164 to control a valve 168 that adjusts the amount of drilling fluid flowing through the drilling motor 120 (FIG. 2) and / or into the power chamber 140. For example, the valve 168 may be positioned uphole of the drilling motor 120 and receive a drilling fluid 172 flowing in the bore of the drill string 18 (FIG. 1). The valve 168 may be configured to adjust an amount of drilling fluid 174 flowing through the drilling motor 120. In some embodiments, the valve 168 may bleed off a portion of the drilling fluid 176 into an annulus surrounding the drill string 18 (FIG. 1). Either method may be used to reduce the flow rate into the drilling motor 120 (FIG. 2) and thus reduces RPM and available WOB.

Likewise, the valve 170 may be used to control the split of fluid flowing into the power chamber 140 (FIG. 2) and the central bore 146 (FIG. 2), which can vary the amount of WOB applied to the drill bit 100. The valve 170 may be positioned in the central bore 146 (FIG. 2), in the passage 144 (FIG. 2), or in the chamber 140 (FIG. 2). In one embodiment, the valve 170 varies the amount of fluid 178 flowing through the central bore 146 (FIG. 2), which then varies the amount of fluid 180 entering the chamber 140 (FIG. 2). Either method may be used to reduce the flow rate into the drilling motor 120 (FIG. 2) and thus reduces RPM and available WOB.

In still other variants, the controller 160 may be programmed to alter drilling dynamics in order to enhance drilling operations. For example, the controller 160 may send control signals to the actuator 164 that cause the valve 168 to modulate or pulse fluid flow. For instance, the valve 168 may vary drilling fluid flow according to a predetermined pattern to thereby generate a fluctuating WOB. The pattern may be a sinusoidal curve, step function, or other predefined increase or decrease in the WOB over a period of time; e.g., 15 Hz, sinusoid, 50% to 100% Amplitude. The amount of fluctuations may be varied to optimize ROP (e.g. improve hole cleaning, reduce friction, optimize depth of cut, etc.).

Also, in embodiments not shown, the actuators 164, 166, may operate devices other than flow control devices. For example, the actuators 164, 166 may control electric motors, signal and/or data transmission systems, levers, sliding sleeves, etc.

In some embodiments, the BHA 12 may include a device such as an inductive brake (not shown) to "artificially" generate a reaction force. In instances where the drill bit 100 does not have resistance to rotation, a pressure differential of sufficient magnitude may not be generated across the drilling motor 120 to generate a thrust. In those situations, a brake mechanism may temporarily resist rotation of the rotor, 122, connector 126, or the drill bit 100 to create the desired pressure differential and displace the drill bit 100.

Figure 4:
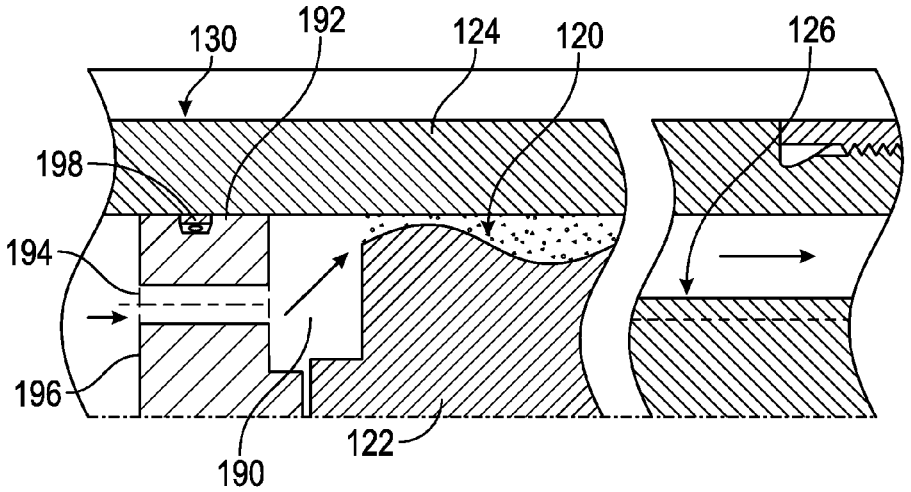
FIG. 4 schematically illustrates a thrust generating drilling motor device made in accordance with one embodiment of the present disclosure that is positioned at an inlet of a drilling motor.

FIG. 4 sectionally illustrates a section of the BHA 12 that uses a thrust generator 130 positioned adjacent to a fluid inlet 190 of the drilling motor 120. As described previously, the drilling motor 120 includes a rotor 122 disposed in a stator housing 124. In this arrangement, the thrust generator 130 is fixed to the rotor 122 and includes a flange 192 having one or more bores 194. The flange 192 has a pressure face 196 against which a pressure differential across the drilling motor 120 may act. The flange may seal against an inner surface with a suitable seal 198. As before, this pressure differential generates an axial force that is transmitted to connector 126 via the rotor 122. It should be appreciated that the thrust generator 130 may be positioned at a variety of locations as long as the thrust generator 130, the drilling motor 120, and the drill bit 100 are connected using a thrust transmitting connection that can convey thrust from the thrust generator 130 to the drill bit 100.

Referring now to FIGS. 1-2, in one illustrative mode of use, the BHA 12 is conveyed into the wellbore 14 to form the deviated wellbore section 17. Pressurized drilling mud is pumped to the BHA 12 from the surface via the drill string 18. The drilling motor 120 uses the pressurized drilling mud to generate rotary power and thrust. In a "sliding mode" of drilling, or "sliding drilling," the drill string 18 does not rotate. Rather, all of the rotary power for the drill bit 100 is generated by the drilling motor 120.

Initially, the force application assembly 110 is actuated to anchor the BHA 12 to the borehole wall 15. In some situations, the drill bit 100 may not have sufficient contact with a surface to encounter a reactive force high enough to induce the desired pressure differential at the drilling motor 120. Thus, the inductive brake (not shown) may be activated to artificially resist rotation of the drill bit 100. Due to the artificial reactive force, the pressure differential across the drilling motor 120 increases, which increases the fluid pressure in the power chamber 140. This fluid pressure is applied to the transverse pressure surfaces of the rib 132, which then creates an axial thrust force. During a power stroke, the axial thrust force displaces the connector 126 and the drill bit 100. The connector 126 is displaced until the inserts 154 in the reset chamber 142 are in contact or nearly in contact. Alternatively, the controller 160 may terminate the power stroke.

A reset stroke begins by deactivating the force application assembly 110 and retracting the pads 112. The deactivation releases the BHA 12 from the borehole wall 15. At this point, the BHA 12 is free to move and the drill bit 100 is in contact with the wellbore bottom 22. Thus, the drill bit 100, the connector 126, and the rotor 122 are held stationary relative to the wellbore bottom 22. The drill string 18 may now be slid using the weight of the drill string 18, a surface source, and/or a downhole source (e.g., a thruster). The enclosure 138 housing the connector 126 is displaced until the inserts 154 in the power chamber 140 are in contact or nearly in contact. Alternatively, the controller 160 may terminate the reset stroke.

It should be understood that the FIG. 2 illustrates in simplified form of one embodiment of the present disclosure. For example, the connector 126 is shown as a unitary element that connects the drill bit 100 to the rotor 122. In other embodiments, the connector 126 may be an assembly of rotating elements, which include flex shafts, couplings, joints, etc. In another example, the force application assembly 110 may be constructed as a separate sub or housing. Also, the force application assembly 110 may be disposed on a sleeve (not shown) rotates relative to a supporting mandrel (not shown). Also, the thrust generator 130 is shown as formed on the connector 126. In other embodiments, the thrust generator 130 may be formed at other locations, such as on the rotor 122.

As used above, the term predetermined refers to a value or quantity that has been specifically engineered to be obtained.

While the foregoing disclosure is directed to the one mode embodiments of the disclosure, various modifications will be apparent to those skilled in the art. It is intended that all variations within the scope of the appended claims be embraced by the foregoing disclosure.

The invention claimed is:

1. An apparatus for forming a wellbore in a subterranean formation, comprising:

a drill bit;

a connector connected to the drill bit, the connector being configured to transmit torque and thrust to the drill bit;

a drilling motor energized by a pressurized fluid, the drilling motor including:

a stator, and a rotor disposed in the stator and having a torque transmitting connection to the connector;

a thrust generator connected to and rotating with the rotor, the thrust generator having a rotating pressure face in pressure communication with a fluid flowing through the drilling motor;

an enclosure enclosing the thrust generator, wherein the rotating pressure face is disposed in a chamber formed between the enclosure and the connector, the chamber in fluid communication with the pressurized fluid flowing through the drilling motor, and the thrust generator rotates relative to the enclosure; and a force application assembly selectively anchoring the stator and the enclosure enclosing the thrust generator to a wellbore wall.

2. The apparatus of claim 1, wherein the thrust generator includes a rib formed on the connector, wherein the rib translates in the chamber, wherein the connector includes a first passage conveying fluid from the drilling motor to the chamber and a second passage conveying fluid from the drilling motor to the drill bit.

3. The apparatus of claim 2, wherein the rib separates the chamber into a power chamber and a reset chamber, wherein a first gap between the enclosure and connector provides fluid communication between the power chamber and the reset chamber and a second gap between the enclosure and the connector provides fluid communication between the reset chamber and a wellbore annulus.

4. The apparatus of claim 1, wherein the force application assembly includes a plurality of radially extendable pads configured to contact a wellbore wall, the force application assembly being configured to anchor the drilling motor stator to the wellbore wall, wherein the drilling motor rotor translates a predetermined distance when the drilling motor stator is anchored to the wellbore wall.

5. The apparatus of claim 4, wherein the pads can be extended to radially different distances at the same time to thereby eccentrically position the drill bit in the wellbore.

6. The apparatus of claim 1, further comprising a controller operably coupled to at least one actuator and in signal communication with at least one sensor, wherein the controller is programmed to control at least one operating parameter associated with the drill bit.

7. The apparatus of claim 6, wherein the at least one actuator controls a flow device and the at least one operating parameter includes at least one of: (i) WOB, (ii) RPM, and (iii) ROP.

8. The apparatus of claim 6, wherein the at least one actuator controls a flow device and the at least one operating parameter is selected from one of: bit bounce, shock, lateral vibration, axial vibration, radial force on the drilling assembly, stick-slip, whirl, bending moment, drill bit wear, bit bounce, whirl, and axial force on the drilling assembly.

9. The apparatus of claim 6, wherein the at least one actuator controls a flow control device and the operating parameter is a depth of cut of the drill bit.

10. The apparatus of claim 6, wherein the at least one actuator controls a flow control device configured to vary a WOB according to a predetermined pattern.

11. A method for forming a wellbore in a subterranean formation, comprising:

forming a drilling assembly having:

a drill bit, a connector connected to the drill bit, the connector being configured to transmit torque and thrust to the drill bit, a drilling motor energized by a pressurized fluid, the drilling motor including: a stator, and a rotor disposed in the stator and having a torque transmitting connection to the connector, a thrust generator connected to and rotating with the rotor, the thrust generator having a rotating pressure face in pressure communication with a fluid flowing through the drilling motor;

an enclosure enclosing the thrust generator, wherein the rotating pressure face is disposed in a chamber formed between the enclosure and the connector, the chamber in fluid communication with the pressurized fluid flowing through the drilling motor, and the thrust generator rotates relative to the enclosure; and force application assembly selectively anchoring the stator and the enclosure enclosing the thrust generator to a wellbore wall.

conveying the drilling assembly into the wellbore; and pushing the drill bit against a wellbore bottom of the wellbore using a thrust generated by the drilling motor.

12. The method of claim 11, wherein the thrust generator includes a rib formed on the connector, and further comprising:

translating the rib in the chamber;

conveying fluid from the drilling motor to the chamber via a first passage; and conveying fluid from the drilling motor to the drill bit via a second passage that is parallel to the first passage.

13. The method of claim 12, wherein the rib separates the chamber into a power chamber and a reset chamber, and wherein a first gap separates the enclosure and the rib and a second gap separates the connector and the enclosure, and further comprising:

providing fluid communication between the power chamber and the reset chamber via the first gap; and providing fluid communication between the reset chamber and a wellbore annulus via the second gap.

14. The method of claim 11, wherein the force application assembly includes a plurality of radially extendable pads configured to contact a wellbore wall, and further comprising:

anchoring the drilling motor stator to the wellbore wall using the force application assembly, wherein the drilling motor rotor translates a predetermined distance when the drilling motor stator is anchored to the wellbore wall.

15. The method of claim 14, further comprising eccentrically positioning the drill bit in the wellbore by extending the pads to radially different distances.

16. The method of claim 11, controlling at least one operating parameter associated with the drill bit using a controller that is operably coupled to at least one actuator and is in signal communication with at least one sensor.

* * * * *